US005526429A

United States Patent [19]

Inanaga et al.

[11] Patent Number: 5,526,429

[45] Date of Patent: Jun. 11, 1996

[54] HEADPHONE APPARATUS HAVING MEANS FOR DETECTING GYRATION OF USER'S HEAD

[75] Inventors: Kiyofumi Inanaga; Yuji Yamada, both of Kanagawa, Japan

[73] Assignee: Sony Corporation, Tokyo, Japan

[21] Appl. No.: 309,878

[22] Filed: Sep. 20, 1994

[30] Foreign Application Priority Data

Sep. 21, 1993 [JP] Japan ..... 5-235029

[51] Int. Cl.[6] ..... H04R 5/00

[52] U.S. Cl. ..... 381/25; 381/74

[58] Field of Search ..... 381/25, 74, 24, 381/1

[56] References Cited

FOREIGN PATENT DOCUMENTS 0438281 7/1991 European Pat. Off. .
0465662 1/1992 European Pat. Off. .
0464217 1/1992 European Pat. Off. .
1-112900 5/1989 Japan .

*Primary Examiner*—Curtis Kuntz
*Assistant Examiner*—Minsun Oh
*Attorney, Agent, or Firm*—Hill, Steadman & Simpson

[57] ABSTRACT

An audio reproducing apparatus includes a signal source, an audio reproducing unit, an address signal generating unit, a memory and an integrating circuit. The signal source outputs digitized audio signals of a plurality of channels. The audio reproducing unit is fitted into listener's ear portions to reproduce the digital audio signals supplied thereto from the signal source by an electro-acoustic transducer. The address signal generating unit generates an address signal based on a detected signal supplied thereto from a detecting unit for detecting listener's head motion relative to the standard direction. The integrating circuit processes the digital audio signals supplied thereto from the signal source and data concerning impulse response, dependent on head position and memorized in the memory. The audio signals supplied to the audio reproducing unit being corrected in response to listener's head motion in a real time fashion.

9 Claims, 5 Drawing Sheets

FIGURE 4

| $\theta$ | Table Address | Impulse Response $h_{m,n}(t,\theta)$ | | | |
|---|---|---|---|---|---|
| | | $h_{LL}(t,\theta)$ | $h_{LR}(t,\theta)$ | $h_{RL}(t,\theta)$ | $h_{RR}(t,\theta)$ |
| 0° | 0 | $h_{LL}(t,0)$ | $h_{LR}(t,0)$ | $h_{RL}(t,0)$ | $h_{RR}(t,0)$ |
| 2° | 1 | $h_{LL}(t,1)$ | $h_{LR}(t,1)$ | $h_{RL}(t,1)$ | $h_{RR}(t,1)$ |
| 4° | 2 | $h_{LL}(t,2)$ | $h_{LR}(t,2)$ | $h_{RL}(t,2)$ | $h_{RR}(t,2)$ |
| 6° | 3 | $h_{LL}(t,3)$ | $h_{LR}(t,3)$ | $h_{RL}(t,3)$ | $h_{RR}(t,3)$ |
| ⋮ | 4 ⋮ | ⋮ | ⋮ | ⋮ | ⋮ |
| 358° | 179 | $h_{LL}(t,358)$ | $h_{LR}(t,358)$ | $h_{RL}(t,358)$ | $h_{RR}(t,358)$ |

HEADPHONE APPARATUS HAVING MEANS FOR DETECTING GYRATION OF USER'S HEAD

BACKGROUND

1. Field of the Invention

The present invention relates to audio reproducing apparatus and, particularly to an audio reproducing apparatus having an audio signal reproducing unit that the listener wears on the head.

2. Background of the Invention

Audio signal reproducing methods using a headphone are known to reproduce an audio signal with the headphone worn by the listener on the head such that the headphone covers listener's ears. Thus, the listener can listen to reproduced sounds of the audio signal from the ears. When the audio signal is reproduced by the headphone as described above, even if a signal from a signal source is of a stereo signal, there occurs a so-called lateralization in which the listener feels reproduced sound image around or within the head.

A binaural pickup sound wave reproduction system is known as one of the audio signal reproducing systems using the headphone. The binaural pickup sound wave reproduction system will be described below.

According to the binaural pickup sound wave reproduction system, microphones called dummy head microphones are fitted into ears of a dummy head which assumes a listener's head. The dummy head microphones pick up an audio signal from a signal source. When the audio signal thus picked up by the dummy head microphones is reproduced by the headphone in actual practice, the listener can obtain presence as if the listener listened to sounds generated from the sound source directly. According to the binaural pickup sound wave reproduction system, it is possible to improve sense of direction, sense of localization and presence of picked-up and reproduced sound image. However, in order to reproduce the audio signal according to the binaural reproduction system, a special signal source should be provided as a signal source to provide a special sound source signal different from that used in the case that the audio signal picked up by the dummy head microphone is reproduced by a speaker apparatus.

Therefore, it is proposed to apply the binaural pickup sound wave reproduction system to a reproducing system to achieve a reproduction effect in which sound image is localized at the position outside the listener's head, e.g., speaker position similarly when a stereo signal is reproduced through the headphone by the speaker apparatus. However, in case the stereo signal is reproduced by using the speaker apparatus, if the listener changes the direction of the head or face, then the absolute direction and position of sound image are not changed but the relative direction and position of sound image that the listener feels are changed. In case the audio signal is reproduced by means of the headphone according to the binaural pickup sound wave reproduction system, if the listener changes the direction of the head or face, the relative direction and position of the sound image that the listener feels are not changed. As a consequence, if the listener changes the direction of the head or face while the audio signal is reproduced in the binaural reproduction system, then sound field is formed within the listener's head. In particular, it is thus difficult to localize sound image in front of the listener. Furthermore, in that case, sound image tends to be localized above the listener's head.

According to a headphone reproduction method described in Japanese published patent publication No. 42-227, the following binaural reproduction method using a headphone is proposed. Specifically, sense of direction and sense of localization of sound image are determined based on some suitable elements, such as a difference of volume of sounds picked up by listener's left and right ears, a time difference, a phase difference or the like. Therefore, according to the above-mentioned reproduction system described in Japanese published patent publication No. 42-227, audio signal lines of left and right channels are provided with level controllers and variable delay circuits. The level controllers and the variable delay circuits of the audio signals of the respective channels are operated under the control of a detected signal obtained when the direction of the listener's head is detected.

However, according to the headphone reproduction method described in Japanese published patent publication No. 42-227, a motor is directly driven by the detected signal obtained when the direction of the listener's head is detected. When the motor is driven by the detected signal, variable resistors and variable capacitors in the level controllers and the variable delay circuits are mechanically controlled by an analog signal. As a result, volume differences and time differences of the audio signals of the respective channels supplied to the headphone after the listener changed the direction of the head should not be changed without a delay of time so that the mechanical motor cannot cope with the motion of the listener's head.

Furthermore, according to the headphone reproduction method described in Japanese published patent publication No. 42-227, when volume differences and time differences are changed, it is necessary to determine changing characteristics of volume differences and time differences based on relative positional relationship between the sound source and the listener, the shape of listener's head, the shape of auricles or the like. Specifically, when volume difference and time difference are changed in accordance with a certain one changing characteristic, positional relationship between the sound source and the listener is fixed and therefore the sense of distance and a distance between the sound sources cannot be changed. Furthermore, since listeners' heads and listeners' auricles are different, degree of effect that the sense of direction, the sense of localization and presence of the picked up and reproduced sound image that the listener felt can be improved is fluctuated.

Japanese published patent publication No. 54-19242 describes a stereo reproduction system in which relationship of changing amounts between the direction of the listener's head and volume differences and time differences of audio signals of respective channels supplied to the headphone can be successively calculated to process the audio signals.

However, in the stereo reproduction system described in Japanese published patent publication No. 54-19242, there should be provided a memory of a vehemently large storage capacity to continuously calculate and memorize relationship of the changing amounts of volume difference and time difference of the audio signals. It is therefore extremely difficult to realize the above-mentioned stereo reproduction system.

In an audio reproducing apparatus described in Japanese laid-open patent publication No. 01-112900, there is described an apparatus which calculates relationship between the changing amounts of volume difference and time difference of these audio signals not successively but discretely to thereby process the audio signals.

The audio reproducing apparatus described in Japanese laid-open patent publication No. 01-112900, however, describes only a theoretical concept with which the audio reproducing apparatus can be applied to both the analog signal processing and the digital signal processing. Accordingly, the above-mentioned audio reproducing apparatus lacks in concreteness required when the audio reproducing apparatus is applied to the commercially-available products by using the analog or digital signal processing.

Any one of the above-mentioned headphone reproduction method, the stereo reproduction system and the audio reproducing apparatus cannot process these audio signals at high speed in response to the motion of the listener's head without the digital signal processing. However, any one of the above-mentioned headphone reproduction method, the stereo reproduction system and the audio reproducing apparatus does not describe the digital signal processing means and the digital signal processing method at all. Therefore, it is difficult to realize the above-mentioned headphone reproduction method, the stereo reproduction system and the audio reproducing apparatus.

Furthermore, it is necessary to provide the memory of large storage capacity to memorize relationship, such as the changing amounts between the volume differences and time differences of these audio signal. Although these relationships cannot be memorized in the memory without the digital signal processing, the digital signal processing means and the digital signal processing method are not described at all. Therefore, it is extremely difficult to realize the headphone reproduction method, the stereo reproduction system and the audio reproducing apparatus.

SUMMARY OF THE INVENTION

It is therefore an object of the present invention to provide an audio reproducing apparatus in which the above-mentioned problems can be solved.

According to the present invention, there is provided an audio reproducing apparatus which includes a signal source, a sound reproducing unit, an address signal generating unit, a memory and an integrating circuit. The signal source outputs digitized audio signals of a plurality of channels. The audio reproducing unit is fitted into listener's ear portions to reproduce the audio signal supplied thereto from the signal source by an electro-acoustic transducer. The address signal generating unit generates an address signal based on a detected signal which detected listener's head motion relative to the standard direction. The memory memorizes data concerning impulse response ranging from a virtual sound source position relative to the standard direction of the listener's head to listener's ears at every angle that the listener can identify. The integrating circuit processes the audio signals from the signal source and the data concerning the impulse response memorized in the memory in a convolution integral fashion. The data concerning the impulse response memorized in the memory is read out from the memory based on the address signal generated by the address signal generating unit and the read-out data concerning the impulse response is supplied to the integrating circuit, in which it is processed in a convolution integral fashion together with the audio signals supplied thereto from the signal source, thereby the audio signals supplied to the audio reproducing unit being corrected in response to listener's head motion in a real time fashion.

According to the present invention, there is provided an audio reproducing apparatus which includes a signal source, a sound reproducing unit, an address signal generating unit, a memory and an integrating circuit. The signal source outputs digital audio signals of a plurality of channels. The audio reproducing unit is disposed at the position near listener's ears to reproduce the digital audio signals supplied thereto from the signal source in the form of analog audio signals. The address signal generating unit generates an address signal based on a detected signal which detected listener's head motion relative to the standard direction. The memory memorizes data concerning impulse response ranging from a virtual sound source position relative to the standard direction of the listener's head to listener's ears at every angle that the listener can identify. The integrating circuit processes the digital audio signals supplied thereto from the signal source and the data concerning the impulse response memorized in the memory in a convolution integral fashion. The data concerning the impulse response memorized in the memory is read out from the memory based on the address signal generated by the address signal generating unit and the digital audio signals are corrected based on the read-out data concerning the impulse response with respect to listener's head motion in a real time fashion.

According to the present invention, there is provided an audio reproducing apparatus which includes a signal source, an analog-to-digital converting circuit, an audio reproducing unit, an angle detecting unit, an address signal generating unit, a memory and an integrating circuit. The signal source supplies analog audio signals of a plurality of channels. The analog-to-digital converting circuit converts the analog audio signals supplied thereto from the signal source to digital audio signals. The audio reproducing unit is disposed at the position near listener's ears to reproduce the digital audio signals supplied thereto from the analog-to-digital converting circuit in the form of analog signals. The angle detecting unit detects listener's head motion relative to the standard direction at every predetermined angle. The address signal generating unit generates an address signal based on a detected signal supplied thereto from the angle detecting unit. The memory memorizes data concerning impulse response ranging from a virtual sound source position relative to the standard direction of listener's head to listener's ears at every angle that the listener can identify. The integrating circuit processes the digital audio signals supplied thereto from the analog-to-digital converting means and the data concerning the impulse response memorized in the memory in a convolution integral fashion. The data concerning the impulse response memorized in the memory is read out from the memory based on the address signal output from the address signal generating unit and the digital audio signal are corrected based on the read-out data concerning the impulse response with respect to the listener's head motion in a real time fashion.

According to the present invention, there is provided an audio reproducing apparatus which includes an analog signal source, a digital signal source, an analog-to-digital converting circuit, a switching unit, an audio reproducing unit, an angle detecting unit, an address signal generating unit, a memory and an integrating circuit. The analog signal source supplies analog audio signals of a plurality of channels. The digital signal source supplies digital audio signals of a plurality of channels. The analog-to-digital converting circuit converts the analog audio signals supplied thereto from the analog signal source to digital signals. The switching unit switches the digital audio signals supplied thereto from the digital signal source and the digital audio signals supplied thereto from the analog-to-digital converting unit. The audio reproducing unit is disposed at the position near listener's ears to reproduce the digital audio signals supplied thereto from the switching unit in the form of analog audio signals. The angle detecting unit detects listener's head motion relative to the standard direction at every predetermined angle. The address signal generating unit generates an address signal based on a detected signal supplied thereto from the angle detecting unit. The memory memorizes data concerning impulse response ranging from a virtual sound source position relative to the standard direction of listener's head to listener's ears at every angle that the listener can identify. The integrating circuit processes the digital audio signals supplied thereto from the switching unit and the data concerning the impulse response memorized in the memory based on the address signal output from the address signal generating unit in a convolution integral fashion. The data concerning the impulse response memorized in the memory is read out based on the address signal output from the address signal generating unit, and the digital audio signals are corrected based on the read-out data concerning the impulse response with respect to listener's head motion.

According to the present invention, there is provided an audio reproducing apparatus which includes a signal source, an audio reproducing unit, an analog angle detecting unit, an analog-to-digital converting circuit, an address signal generating unit, a memory and an integrating circuit. The signal source supplies digital audio signals of a plurality of channels. The audio reproducing unit is disposed at the position near listener's ears to reproduce the digital audio signals supplied thereto from the signal source in the form of analog signals. The analog angle detecting unit detects listener's head motion relative to the standard direction at every predetermined angle in an analog fashion. The analog-to-digital converting circuit converts an analog signal detected by the analog angle detecting unit to a digital angle signal. The address signal generating unit generates an address signal based on the digital signal output from the analog-to-digital converting circuit. The memory memorizes data concerning a virtual sound source position relative to the standard position of listener's head to listener's ears at every angle that the listener can identify. The integrating circuit processes the digital audio signals supplied thereto from the signal source and the data concerning the impulse response memorized in the memory in a convolution integral fashion. The audio reproducing apparatus reads out data concerning the impulse response memorized in the memory based on the address signal output from the address signal generating unit, and corrects the digital audio signals based on the read-out data concerning the impulse response with respect to the listener's head motion in a real time fashion.

According to the present invention, it is possible to correct the audio signals supplied to the audio signal reproducing unit based on the listener's head motion in a real time fashion by processing the digitized audio signal supplied thereto from the signal generating apparatus and the data concerning the impulse response that is memorized in the memory at every angle that the listener can identify. Further, according to the present invention, it is possible to reduce the storage capacity of the memory.

BRIEF DESCRIPTION OF THE DRAWINGS

FIG. 4 is a diagram showing a table of impulse responses in the audio reproducing apparatus according to the embodiment of the present invention.

DESCRIPTION OF THE INVENTION

An audio reproducing apparatus according to an embodiment of the present invention will hereinafter be described with reference to FIGS. 1 through 5.

The audio reproducing apparatus according to the embodiment of the present invention can reproduce by using a headphone an audio signal with sense of localization and presence substantially the same as those of sounds reproduced by a speaker apparatus located with a predetermined positional relationship determined by the speaker apparatus when the audio signal is reproduced by the headphone.

The audio reproducing apparatus according to the embodiment of the present invention is used in the system in which multichannel audio signals output from a stereo audio signal source or the like are reproduced by the headphone. In particular, the audio reproducing apparatus according to this embodiment is used to reproduce a digitized audio signal recorded in or transmitted to multiple channels in order to localize respective sound images in a predetermined positional relationship (e.g., listener's front right, front left, center and others) by some suitable means, such as a headphone or the like.

Initially, listener's head gyration relative to the standard direction is detected at every constant angle or every predetermined angle. Then, a digital address signal representing a magnitude including a direction is generated on the basis of a detected result. Based on this digital address signal, data concerning impulse response digitally recorded from a virtual sound source position relative to the standard position of the listener's head to listener's ears previously-recorded in the memory is read out from the memory. Then, digitized audio signals of the respective channels and data concerning the impulse response are processed by a convolution integrator, corrected and varied in a real time. Thus, it is possible to realize a reproduction effect such that sounds can be reproduced as if the listener could listen to sounds directly reproduced from the speaker apparatus located at the virtual sound source position.

Figure 1A:
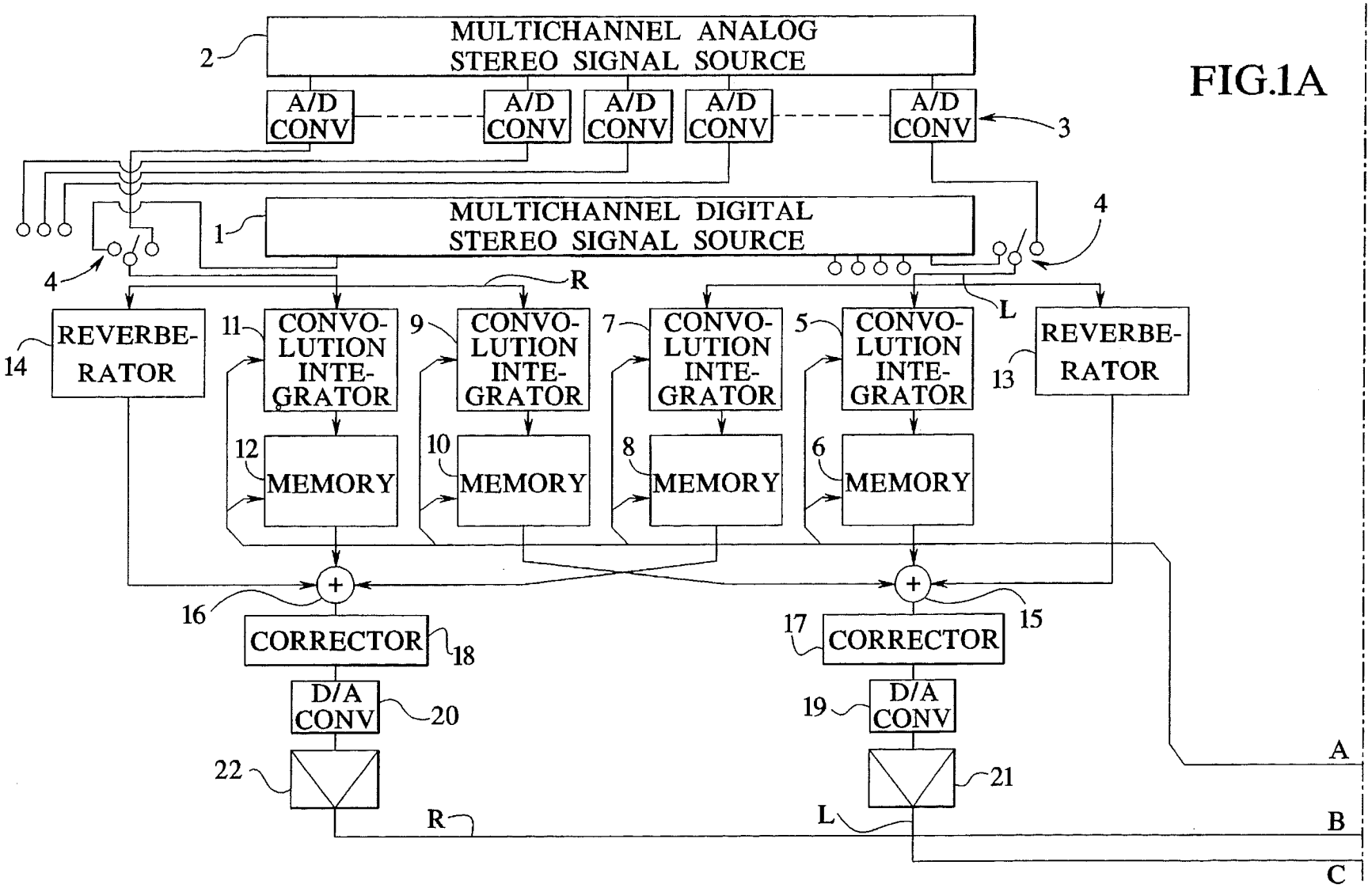
FIG. 1 is a block diagram showing an audio reproducing apparatus according to an embodiment of the present invention.
Figure 1B:
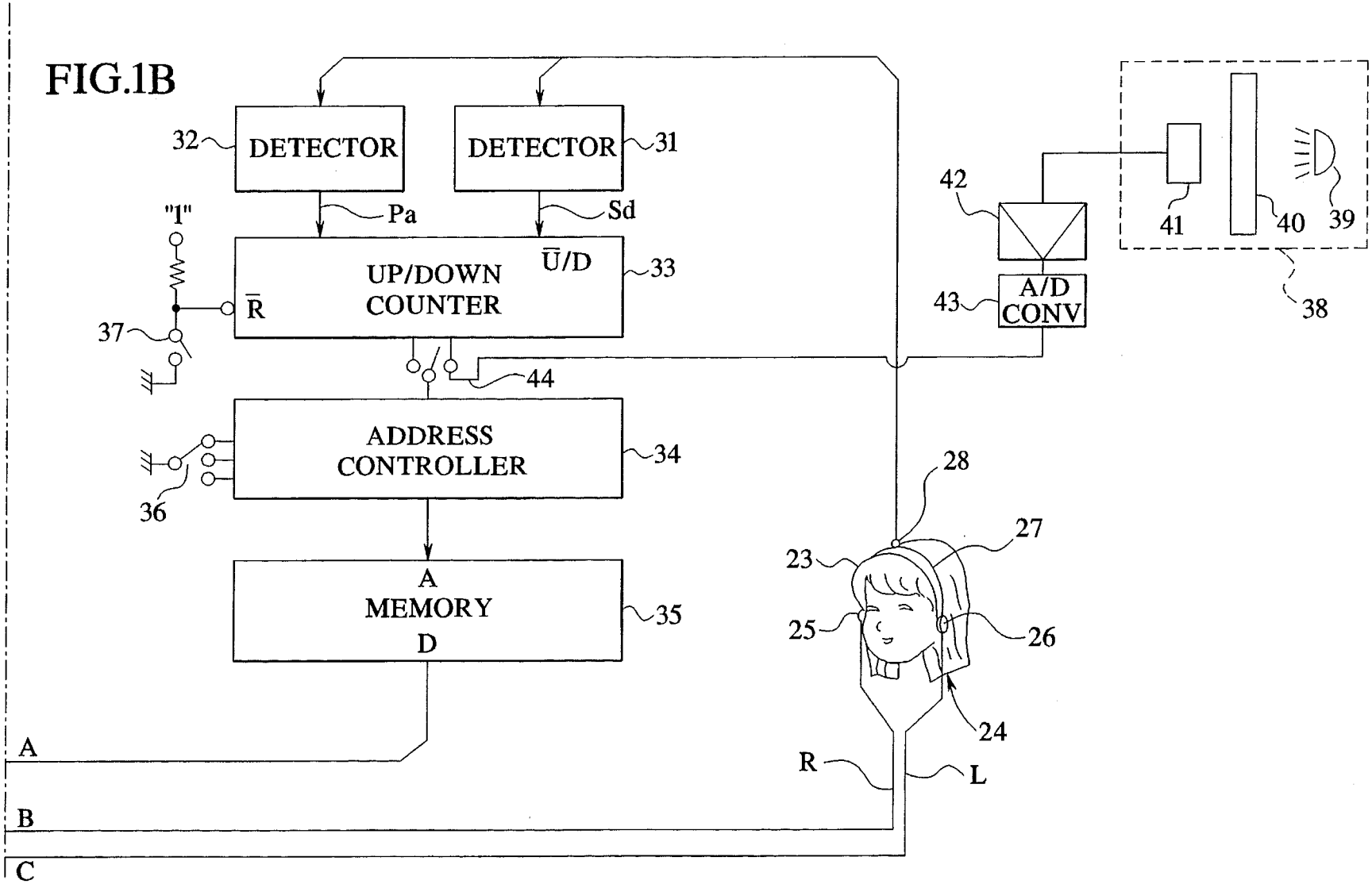

In FIG. 1, reference numeral 1 designates a digital audio disc, e.g., compact disc and a multi-channel digital stereo signal source, such as a digital satellite broadcasting or the like. Reference numeral 2 designates an analog stereo signal source, such as an analog record, an analog broadcasting or the like. Reference numeral 3 designates an analog-to-digital (A/D) converter 3. The number of the A/D converter 3 is increased in accordance with the number of channels in the case of the multichannel audio signals. In FIG. 1, reference numeral 4 designates a switcher in which a signal input in the form of a digital signal and a signal input in the form of an analog signal are equally treated as a digital signal which is expressed by a predetermined sampling frequency and a predetermined quantization bit number. Although the switcher 4 is provided to switch the two channels, the number of switchers 4 is similarly increased in accordance with the number of channels in the case of the multichannel audio signals.

A left digital signal L of these digital signal trains is supplied to a convolution integrator 5. Then, the left digital signal L and data concerning a set of impulse responses recorded as digital data expressed by a predetermined sampling frequency and a predetermined quantization bit number, ranging from the virtual sound source position relative to the head standard direction in which the listener 23 turns the head to listener's ears and which are read out to the memory 6 of the convolution integrator 5 are processed in a convolution integral fashion. A convolution integrator 7 and a memory 8 supply a crosstalk component of the right digital signal R to an adder 16.

The right digital signal R is supplied to a convolution integrator 11 similarly as described above. The right digital signal R and data concerning a set of impulse responses recorded as digital data expressed by a predetermined sampling frequency and a predetermined quantization bit number, ranging from the virtual sound source position relative to the standard direction of the head of the listener 23 to listener's ears and which are read out to a memory 12 of the convolution integrator 11 are processed in a convolution integral fashion. A convolution integrator 9 and a memory 10 supply a crosstalk component of the left digital signal L to an adder 15.

The data concerning the impulse response and processed results which result from the real time convolution integral by the convolution integrator 5 and the memory 6 and the convolution integrator 9 and the memory 10 are supplied to and added by the adder 15. Further, the data concerning impulse response and processed results which result from the real time convolution integral by the convolution integrator 7 and the memory 8 and the convolution integrator 11 and the memory 12 are supplied to and added by the adder 16. At that very time, reverberation signals from reverberation circuits 13, 14 are supplied to the adders 15, 16.

Results that were processed in a convolution integral fashion and added by the adders 15, 16 are corrected by correcting circuits 17, 18 in order to remove characteristics inherent in the headphone used to measure the impulse response, and converted by digital-to-analog (D/A) converters 19, 20 to analog signals. The analog signals from the D/A converters 19, 20 are amplified in power by power amplifiers 21, 22 and then applied to a headphone 24. Thus, the listener 23 can listen to sounds through right and left sound generating members 25, 26 of the headphone 24.

The correcting circuits 17, 18 may be provided at any portions of the path in which signals are added with audio signals by the signal source 1 which supplies multichannel digital stereo signals and the signal source 2 which supplies multichannel analog signals, variously processed and then supplied to the headphone 24. The correcting circuits 17, 18 may correct the above-mentioned results either in an analog signal processing fashion or in a digital signal processing fashion.

When data concerning a set of impulse responses memorized as digital data ranging from the virtual sound source position relative to the standard direction to the listener's ears are processed by the convolution integrators 5, 7, 9, 11 and the memories 6, 8, 10, 12, it is possible to perform a convolution integral including the correction in real time by setting data concerning impulse response of the correcting coefficient of the headphone 24 as impulse responses previously-processed by the convolution integrators.

Figure 2:
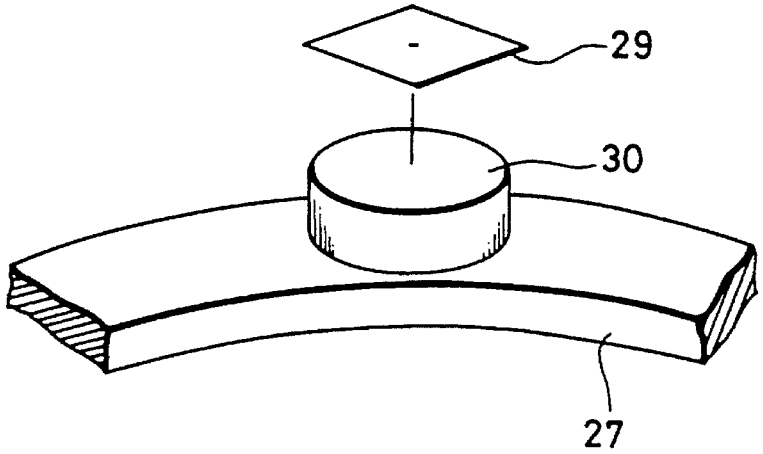
FIG. 2 is a schematic perspective view showing an arrangement of a digital angle detector used in the audio reproducing apparatus according to the embodiment of the present invention.

A digital angle detector 28 is adapted to detect the head gyration of the listener 23. FIG. 2 shows an arrangement of the digital angle detector 28 in detail. The digital angle detector 28 shown in FIG. 2 makes effective use of horizontal component forces of earth magnetism. FIG. 2 shows an example that the digital angle detector 28 generates an angle detected signal as a digital signal.

The example that the head gyration of the listener 23 relative to the standard direction is detected at very constant unit angle or at every previously-determined angle as discrete information will be described below. As shown in FIG. 2, the digital angle detector 28 includes a rotary encoder 30 provided at its head center position such that an input axis of the rotary encoder 30 becomes vertical. Also, the digital angle detector 28 includes a magnetic needle 29 provided at the input axis thereof. The rotary encoder 30 generates an output representing listener's head gyration including the direction of the listener 23 with reference to the north and south direction indicated by the magnetic needle 29. While the rotary encoder 30 is attached to a headband 27 of the headphone 24 as shown in FIG. 2, the present invention is not limited thereto and the rotary encoder 30 may be attached to an attachment device that is provided independently of the headband 27.

An output signal of the rotary encoder 30 of the digital angle detector 28 is supplied to detecting circuits 31, 32. The detecting circuit 31 generates a direction signal Sd which goes to low level "0" or high level "1" when the listener 23 turns the head in the clockwise direction or in the counterclockwise direction. The detecting circuit 32 generates a pulse Pa whose number is proportional to the changed angle, i.e., one pulse Pa each time the angle of the head of the listener 23 is changed by each 2°.

The signal Sd is supplied to a count direction input terminal U/D of an up/down counter 33, and the pulse Pa is supplied to a clock input (count input) terminal CK of the up/down counter 33. The count output of the up/down counter 33 is converted to a digital address signal representing the direction and size of the head of listener 23, and then supplied through an address controller 34 to a memory 35 as an address signal.

Then, data concerning impulse response ranging from the virtual sound source position relative to the standard direction of the head of the listener 23 to both ears of listener 23, previously stored in a memory 35 is read out from the memory 35 at its corresponding address of the incorporated table. At the same time, the digitized audio signals of respective channels loaded to the memories 6, 8, 10, 12 of the convolution integrators 5, 7, 9, 11 and the data concerning the impulse response are processed in a convolution integral fashion. As a consequence, the digitized audio signals are corrected in a real time fashion in accordance with the present direction of the head of the listener 23.

Figure 3:
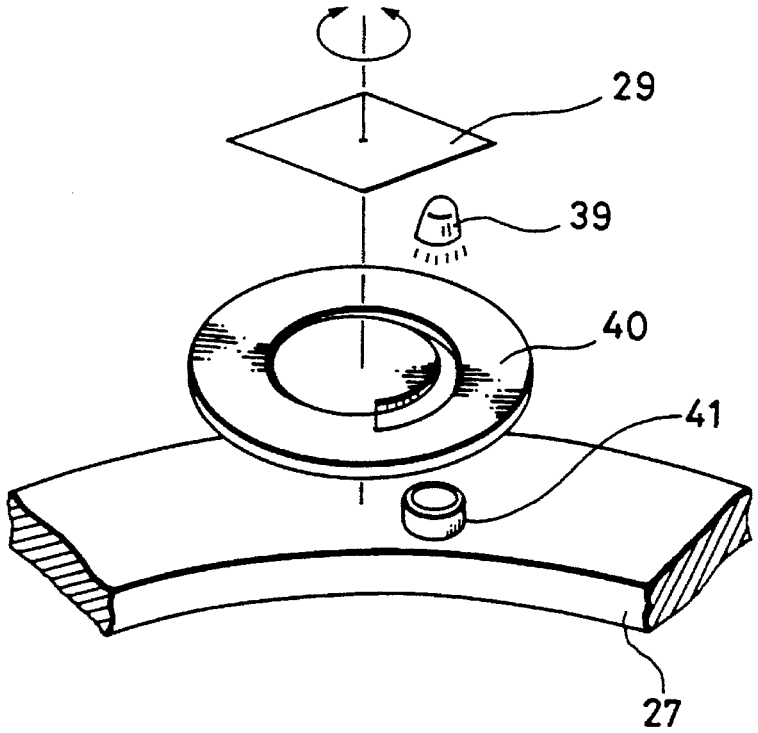
FIG. 3 is a schematic perspective view showing an arrangement of an analog angle detector used in the audio reproducing apparatus according to the embodiment of the present invention.

In FIG. 1, reference numeral 38 designates an analog angle detector. FIG. 3 shows an arrangement of the analog angle detector 38 in detail. FIG. 3 shows an example that the analog angle detector 38 generates an angle detected output as an analog signal. As shown in FIG. 3, the analog angle detector 38 includes a photosensor 41 disposed on the center portion of the headband 27. This photosensor 41 is of a photo sensor element, such as a cadmium sulphide cell (CdS cell), a photodiode or the like whose resistance value changes in response to light intensity. The analog angle detector 38 includes a light emitting device 39, such as a bulb and a light emitting diode, disposed thereon in an opposing relation to the photosensor 41. Light of predetermined intensity is radiated to the photosensor 41 from the light emitting device 39.

A movable shutter 40 is disposed in the light path of light emitted from the light emitting device 39 to change transmittance based on a rotational angle thereof. The movable shutter 40 rotates together with the magnetic needle 29. Thus, when the photosensor 41 is energized by a constant current, the analog angle detector 38 generates a voltage across the photosensor devices of the photosensor 41 as an analog output which represents a head motion including the direction of the head of the listener 23 on the basis of the north and south direction indicated by the magnetic needle 29. While the analog angle detector 38 is attached to the headband 27 of the headphone 24 as described above, the present invention is not limited thereto and the analog angle detector 38 may be attached onto an attachment device disposed independently of the headband 27.

The analog output from the analog angle detector 38 is amplified by an amplifier 42 and converted by an A/D converter 43 to a digital output. The digital output from the A/D converter 43 is supplied through a switcher 44 to the address controller 34. The address controller 34 generates a digital address signal representing the head gyration of the listener 23 relative to the standard direction as magnitude including a direction of every predetermined angle or every previously-determined angle. This digital address signal is supplied to the memory 35 as an address signal.

Data concerning impulse response ranging from the virtual sound source relative to the standard direction of the head of the listener 23 to both ears of the listener 23 is read out from the memory 35 at its corresponding address within the table. Simultaneously, digitized audio signals of the respective channels loaded to the memories 6, 8, 10, 12 of the convolution integrators 5, 7, 9, 11 and the data concerning the impulse response are processed in a convolution integral fashion so that the digitized audio signals and the data representing the direction of the head of the listener 23 are corrected in a real time fashion.

Figure 5:
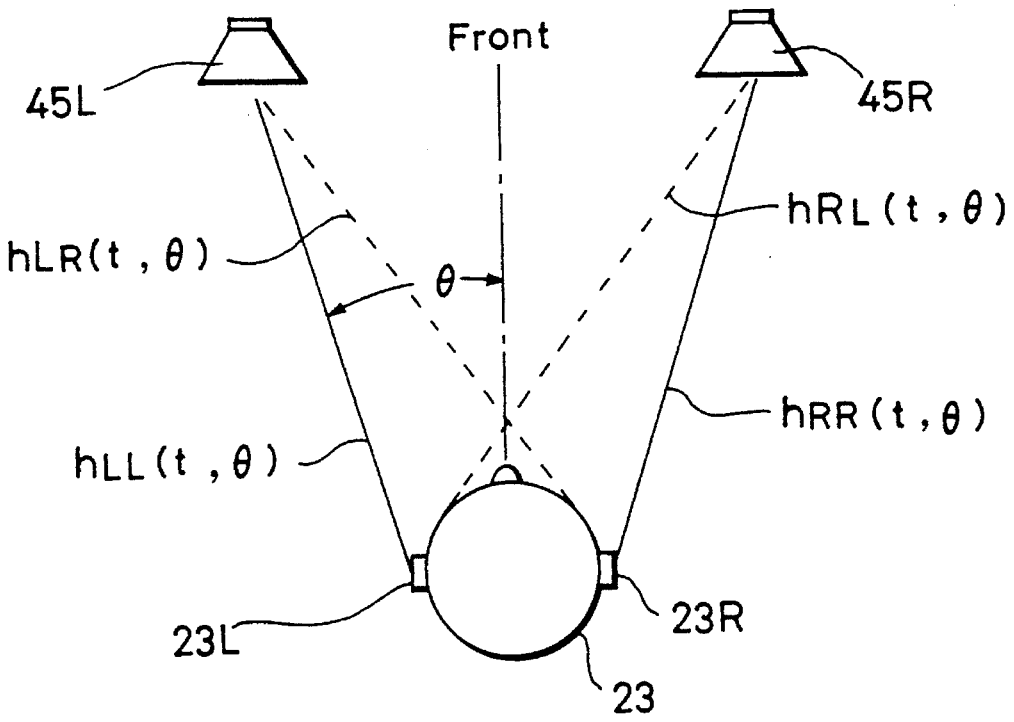
FIG. 5 is a schematic diagram used to explain how to measure impulse response in the audio reproducing apparatus according to the embodiment of the present invention.

FIG. 4 shows an example of data stored within the memory 35. When front left and front right speakers 45L, 45R are disposed in front of the listener 23 as shown in FIG. 5, if the following impulse responses ranging from the disposed positions of the left and right speakers 45L, 45R to both ears of the listener 23 are considered as:

$$hLL(t,\theta) = 1/2\pi \int_{-\infty}^{\infty} HLL(\omega,\theta) \cdot \exp(j\omega t)d\omega \quad (1)$$

$$hLR(t,\theta) = 1/2\pi \int_{-\infty}^{\infty} HLR(\omega,\theta) \cdot \exp(j\omega t)d\omega \quad (2)$$

$$hRL(t,\theta) = 1/2\pi \int_{-\infty}^{\infty} HRL(\omega,\theta) \cdot \exp(j\omega t)d\omega \quad (3)$$

$$hRR(t,\theta) = 1/2\pi \int_{-\infty}^{\infty} HRR(\omega,\theta) \cdot \exp(j\omega t)d\omega \quad (4)$$

Data concerning the impulse response memorized as digital data are memorized in the table of the memory 35 where $h_{mn}(t,\theta)$ represents the impulse response ranging from m speaker positions to n ears, θ represents the angle formed by the m speaker positions and the head of the listener, Hmn(ω, θ) represents the transfer function ranging from the m speaker positions to the n ears, and ω represents the angular frequency (2πf, f: frequency). As a sound source for measuring impulse response, it is possible to employ a speaker apparatus. Further, it is possible for the listener 23 to pick up sounds at any positions of the entrance of the external auditory meatus to the ear drum of each ear.

It is however requested that the sound pick up position is equal to the position at which a correcting characteristic for canceling characteristics, which is used to measure impulse response, inherent in the headphone as will be described later on, is obtained.

Having considered such impulse response, data concerning the impulse response obtained when the angle: θ is changed at every unit angle, e.g., each 2° is written in each first address of the table of the memory 35. This angle is changed at every angle such that the listener 23 can distinguish the head gyration angle with both ears when the listener 23 turns the head. The memory 35 includes a plurality of tables, e.g., three sets of tables. For each set of tables, the shapes of the head and the auricles of the listener 23 are varied and values of data are varied in response to characteristics of the headphone used to measure the impulse response. One of the three sets of tables is selected by the switcher 36 in the address controller 34.

In FIG. 1, reference numeral 37 depicts a reset switch. When the reset switch 37 is energized, a count value of the up/down counter 33 is reset to "all 0", and an address of θ=0 is selected from the table of the memory 35.

The audio reproducing apparatus according to this embodiment is arranged as described above. Operation of the audio reproducing apparatus will next be described below.

Digital audio signals from the multichannel digital stereo signal source 1 or audio signals of respective channels which result from converting analog signals from the multi-channel analog stereo signal source 2 to digital signals by the A/D converter 3 are selected by the switcher 4. Digital signals that were selectively output from the switcher 4 are converted by the convolution integrators 5, 7, 9, 11, the memories 6, 8, 10, 12 and the adders 15, 16 to digital signals having spatial information as sound field to be supplied to both ears of the listener 23. The digital signals output from the adders 15, 16 are supplied though the headphone correcting circuits 17, 18 used to measure impulse response to the D/A converters 19, 20, in which they are converted to analog signals, amplified in power by the power amplifiers 21, 22 and then fed to the headphone 24.

In this case, when the listener 23 moves the head, the digital angle detector 28 generates, in case the digital angle detector 28 is employed, the signals Sd and Pa corresponding to the direction of the head of the listener 23. Thus, the up/down counter 33 generates a count value corresponding to the direction of the head of the listener 23. The count value of the up/down counter 33 is supplied through the address controller 34 to the memory 35 as an address signal. From the memory 35, there is read out data concerning impulse response ranging a virtual sound source position relative to the standard direction of the listener's head corresponding to the direction of the head of the listener 23 to the listener's ears of data corresponding to the table shown in FIG. 4. Read-out data concerning the impulse response is supplied to convolution integrators 5, 7, 9, 11 and the memories 6, 8, 10, 12.

In case the analog angle detector 38 for detecting a head gyration is used, the analog signal is amplified by the amplifier 42 as the sensor output and then converted by the A/D converter 43 to a digital signal conforming to the direction of the head of the listener 23. The digital signal from the A/D converter 43 is supplied to the address controller 34 and the address controller 34 generates an address signal based on the digital signal supplied thereto. The address signal thus generated is supplied to the memory 35. Similarly to the case of the digital angle detector 28, data concerning impulse response ranging from the virtual sound source position relative to the standard direction of the head corresponding to the direction of the head of the listener 23 to the listener's ears is read out from the memory 35 based on the address signal supplied thereto. The data thus read out is supplied to the convolution integrators 5, 7, 9, 11 and the memories 6, 8, 10, 12.

The convolution integrators 5, 7, 9, 11 and the memories 6, 8, 10, 12 effect convolution integral on the left and right audio signals L, R supplied to the headphone 24 together with data concerning the impulse response ranging from the virtual sound source position relative to the standard direction of the head corresponding to the direction of the head of the listener 23 to the listener's ears. Therefore, it is possible for the listener 23 to obtain the sense of sound field as if a plurality of speaker apparatus were disposed at the virtual sound source positions to reproduce sounds.

In particular, according to this embodiment, when characteristics of the audio signals supplied to the headphone 24 are varied in accordance with the direction of the head of the listener 23 based on the table memorized in the memory 35, the characteristics of the audio signals can be fine varied in accordance with the direction of the head of the listener 23. Therefore, it is possible to obtain optimum characteristics of the audio signals.

Further, since data concerning impulse response memorized on the table of the memory 35 is read out and the read-out data is supplied to the convolution integrators 5, 7, 9, 11 and the memorizes 6, 8, 10, 12, the characteristics of the audio signals can be varied in accordance with the direction of the head of the listener 23 without delay of time. Thus, it is possible to prevent reproduced sounds from becoming unnatural.

At that very time, since the reverberation signals also are supplied to the headphone 24 from the reverberation circuits 13, 14, spacial impression obtained in a listening room or in a concert hall is added to reproduced sounds. Therefore, it is possible to obtain the sense of excellent stereo sound field.

On the other hand, since the memory 35 includes a plurality of tables that the listener 23 can arbitrarily select by the switcher 36, even when the shapes of the head and the auricles of the listener 23 and characteristics of a headphone employed by the listener 23 are different, it is possible to obtain optimum characteristics. Further, if the amount in which data concerning impulse response ranging from a virtual sound source position relative to the standard direction of the head of the listener 23 to the listener's ears is changed with respect to the change of the angle θ is increased or decreased as compared with a standard value based on the tables stored in the memory 35, then the changing amounts of the position of the sound image relative to the direction of the head of the listener 23 becomes variable. Thus, it is possible to vary the sense of distance from the listener 23 to the sound image, etc.

Since the reverberation signals generated by the reverberation circuits 13, 14 are added to the audio signals and these reverberation signals are reproduced as sounds reflected on the wall of the concert hall or the like and reverberated sounds, it is possible for the listener 23 to obtain presence as if the listener 23 were seated to listen to a piece of music in the concert hall.

Data on the table shown in FIG. 4 can be obtained as follows. Impulse sound sources with channels of the required number and dummy head microphones are disposed at predetermined positions in a suitable room. It is possible to employ speaker apparatus as sound sources for measuring impulse response in that case.

Although the dummy head microphones may pick up sounds at any positions of listener's ears ranging from external auditory meatus to ear drum, such position is required to be equal to the position at which correction characteristics for canceling characteristics inherent in the headphone used to measure the impulse response are obtained.

Impulse responses are measured by using the dummy head microphones fitted into ears of the dummy head to pick up impulse sounds radiated from speaker positions of respective channels at every predetermined angle, i.e., Δθ. Therefore, at a certain angle, i.e., θ1, it is possible to obtain data concerning a set of impulse responses per channel. Thus, if a signal source of 5 channels is employed as the impulse sound source, it is then possible to obtain data concerning 5 sets of impulse responses at every angle, i.e., 10 kinds of impulse responses.

The correction characteristic that is used to cancel the characteristics inherent in the headphone employed when the impulse response is measured can be obtained by using the same dummy head microphones as those used to pick up impulse response of sound field. The headphone used in actual reproduction is mounted on the dummy head, and data concerning impulse response between the dummy head microphones of ears of the dummy head and data concerning impulse response which presents inverse characteristics are calculated from the input of the headphone.

Alternatively, it is possible to directly obtain such correction characteristic by adaptive processing, such as least means square (LMS) algorithm or the like. Specifically, the characteristics inherent in the headphone are corrected at arbitrary time period in which signals are applied to the headphone after an audio input signal was input to the speaker apparatus. Processing in the time region concerning correction of characteristics inherent in the headphone is implemented by processing data concerning impulse response expressing calculated correction characteristics in a convolution integral fashion. Alternatively, from an analog standpoint, it is possible to correct the characteristics inherent in the headphone by processing data concerning impulse response by an analog filter having an inverse characteristic after the data concerning impulse response was converted in the form of digital to analog data.

While only the direction of the head of the listener 23 on the horizontal plane was considered so far, the present invention is not limited thereto and similar processing can be carried out even when the head of the listener 23 is gyrated on the vertical plane or on the planes perpendicular to the horizontal and vertical planes.

Even when the memory 35 includes one set of tables and the addresses of the tables are varied by the address controller 34, it is possible to obtain control data similarly when the memory 35 includes a plurality of sets of tables.

Data on the table may be limited to a range of general direction of the listener's head. Further, it is possible to change the interval of the angle θ in accordance with the direction of the listener's head, in such a way as to set the angle θ to 0.5° when θ=0° is satisfied substantially and to set the angle θ at the interval of 3° when $|\theta \geqq 45°|$ is satisfied. As described above, it is possible to set the angle θ at the unit of angles in which the listener 23 can identify the angle of head gyration. Furthermore, it is possible to employ speaker apparatus disposed near the ears of the listener 23 instead of the headphone 24.

According to the embodiment of the present invention, input audio signals may be multichannel digital recorded or transmitted signals and analog recorded or transmitted signals output from the stereo signal source. Also, it is possible to use any one of the angle detecting apparatus for detecting the head gyration of the listener 23 from which a detected signal is output in the form of a digital or analog signal.

According to the embodiment of the present invention, when the characteristics of the audio signal supplied to the headphone 24 are corrected in synchronism with the head gyration of the listener 23, the characteristics of the audio signal are corrected based on the data concerning impulse response read out from the table of the memory 35, not continuously for the head gyration of the listener 23 but at the unit of the suitable predetermined angle or at the unit of the previously-determined angle sufficient so that the listener 23 can identify such angle in accordance with human being auditory characteristic. Therefore, if data of the changed contents necessary for the direction of the head of the listener 23 are calculated, it is then possible to achieve the same effects as those achieved when data concerning impulse response are read out from the table of the memory 35 in accordance with the head gyration of the listener 23. Thus, the storage capacity of the memory 35 can be saved and data need not be calculated at higher calculation processing speed than is necessary.

According to the embodiment of the present invention, since the binaural characteristics are obtained from the sound source which is constantly fixed in the predetermined direction regardless of the head gyration of the listener 23, it is possible for the listener 23 to obtain extremely natural sense of localization.

According to the embodiment of the present invention, since characteristics expressed by the impulse response are controlled by carrying out the convolution integral with the convolution integrators 5, 7, 9, 11 and the memorizes 6, 8, 10, 12 in accordance with the table of the memory 35, it is possible to prevent the characteristics from being deteriorated substantially completely. Also, it is possible to prevent the characteristics of the audio signal from being delayed when the characteristics of the audio signal are changed in accordance with the motion of the head of the listener 23. Therefore, in the audio reproducing apparatus according to this embodiment, it is possible to prevent reproduced sounds from becoming unnatural unlike the conventional audio reproducing system.

According to the embodiment of the present invention, the memory 35 includes a plurality of tables which the listener 23 can arbitrarily select with the switcher 36. Consequently, it is possible to obtain optimum characteristics even when the shapes of the head and the auricles of the listener 23 and the characteristics of the headphone 24 are different.

According to the embodiment of the present invention, since the changing amount of the impulse response relative to the change of the angle θ is increased or decreased based on the table of the memory 35 as compared with the standard value, it is possible to change the amount in which the position of the sound image is changed in accordance with the direction of the head of the listener 23. Thus, it is possible to vary some auditory factors, such as the sense of distance ranging from the listener 23 to the sound image or the like.

According to the embodiment of the present invention, since the proper reverberation signals are added to the audio signals by the reverberation circuits 13, 14 if required, the listener can obtain presence as if the listener were seated to listen to a piece of music played in the famous concert hall.

Having described a preferred embodiment of the invention with reference to the accompanying drawings, it is to be understood that the invention is not limited to that precise embodiment and that various changes and modifications could be effected therein by one skilled in the art without departing from the spirit or scope of the invention as defined in the appended claims.

What is claimed is:

1. An audio reproducing apparatus comprising:

signal generating means for supplying digitized audio signals of a plurality of channels;

audio reproducing means worn by the listener on the ears and electro-acoustically converting and reproducing audio signals from said signal generating means;

address signal generating means for generating an address signal based on a detected signal detecting a motion of listener's head relative to a standard;

memory means for memorizing data concerning impulse response ranging from a virtual sound source position relative to a standard position of listener's head to listener's ears at every angle of head gyration that can be identified by the listener with the ears; and integrating means for processing said audio signals generated from said signal generating means and data concerning the impulse response memorized in said memory means in a convolution integral fashion, wherein said data concerning said impulse response memorized in said memory means is read out from said memory means based on said address signal generated by said address signal generating means, said read-out data concerning said impulse response is supplied to said integrating means, in which said data and said audio signals from said signal generating means are processed in a convolution integral fashion to thereby correct said audio signals supplied to said audio reproducing means in response to listener's head gyration in real time.

2. An audio reproducing apparatus according to claim 1, further comprising:

reverberating means supplied with said audio signals from said signal generating means and wherein an output signal from said reverberating means is added to an output signal from said integrating means and supplied to said audio reproducing means.

3. An audio reproducing apparatus according to claim 1, further comprising:

angle detecting means for detecting listener's head gyration and wherein a detected signal from said angle detecting means is supplied to said address signal generating means.

4. An audio reproducing apparatus according to claim 1, wherein said signal generating means comprises:

an analog signal source for outputting analog audio signals of a plurality of channels;

a digital signal source for outputting digital audio signals of a plurality of channels; and analog-to-digital converting means for converting an analog audio signal output from said analog signal source to a digital audio signal.

5. An audio reproducing apparatus according to claim 4, further comprising:

switching means for selectively switching and supplying a digital audio signal which results from converting said analog audio signal from said analog signal source by said analog-to-digital converting means and said digital audio signal from said digital signal source to said integrating means.

6. An audio reproducing apparatus comprising:

a signal source for supplying digitized audio signals of a plurality of channels;

audio reproducing means worn by the listener on the ears and electro-acoustically converting and reproducing audio signals from said signal generating means;

address signal generating means for generating an address signal based on a detected signal detecting a motion of listener's head relative to a standard;

memory means for memorizing data concerning impulse response ranging from a virtual sound source position relative to a standard direction of listener's head to listener's ears at every angle of head gyration that can be identified by the listener with the ears; and integrating means for processing said digital audio signals generated from said signal source and data concerning the impulse response memorized in said memory means in a convolution integral fashion, wherein said data concerning said impulse response memorized in said memory means is read out from said memory means based on said address signal generated by said address signal generating means, said read-out data concerning said impulse response is supplied to said integrating means, in which said data and said audio signals from said signal generating means are processed in a convolution integral fashion to thereby correct said audio signals supplied to said acoustic reproducing means in response to listener's head gyration in real time.

7. An audio reproducing apparatus comprising:

a signal source for supplying analog audio signals of a plurality of channels;

analog-to-digital converting means for converting analog audio signals supplied thereto from said signal source to digital audio signals;

audio reproducing means disposed at the positions near listener' ears and converting said digital audio signals from said analog-to-digital converting means to analog audio signals to be reproduced;

angle detecting means for detecting listener's head motion relative to the standard direction;

address signal generating means for generating an address signal based on a detected signal from said angle detecting mean;

memory means for storing data concerning impulse response ranging from a virtual sound source position relative to the standard direction of listener's head to listener's ears at every angle that the listener can identify; and integrating means for processing said digital audio signal from said analog-to-digital converting means and said data concerning said impulse response memorized in said memory means in a convolution integral fashion, wherein said data concerning said impulse response memorized in said memory means is read out from said memory means based on said address signal output from said address signal generating means, and said digital audio signal is corrected based on said read-out data concerning said impulse response with respect to listener's head motion in a real time fashion.

8. An audio reproducing apparatus comprising:

an analog signal source for supplying analog audio signals of a plurality of channels;

a digital signal source for supplying digital audio signals of a plurality of channels;

analog-to-digital converting means for converting said analog audio signals supplied thereto from said analog signal source to digital audio signals;

switching means for switching said digital audio signals supplied thereto from said digital signal source and said digital audio signals supplied thereto from said analog-to-digital converting means;

audio reproducing means disposed at the position near listener's ears and converting said digital audio signals supplied thereto from said switching means to analog audio signals and reproducing the same;

angle detecting means for detecting listener's head motion relative to the standard direction at every predetermined angle;

address signal generating means for generating an address signal based on a detected signal supplied thereto from said angle detecting means;

memory means for storing data concerning impulse response ranging from a virtual sound source position relative to the standard direction of listener's head to listener's ears at every angle that the listener can identify; and integrating means for processing said digital audio signals supplied thereto from said switching means and said data concerning said impulse response memorized in said memory means, wherein said data concerning said impulse response memorized in said memory means is read out from said memory means based on said address signal output from said address signal generating means and said digital audio signals are corrected based on said read-out data concerning said impulse response with respect to listener's head motion in a real time fashion.

9. An audio reproducing apparatus comprising:

a signal source for supplying digital audio signals of a plurality of channels;

audio reproducing means disposed at the position near listener's ears and converting said digital audio signals supplied thereto from said signal source to analog signals and reproducing the same;

angle detecting means for detecting listener's head motion relative to the standard direction at every predetermined angle and outputting an analog detected signal;

analog-to-digital converting means for converting an analog detected signal output thereto from said angle detecting means to a digital angle signal;

address signal generating means for generating an address signal based on said digital signal output thereto from said analog-to-digital converting means;

memory means for storing data concerning impulse response ranging from a virtual sound source position relative to the standard direction of listener's head to listener's ears at every angle that the listener can identify; and integrating means for processing said digital audio signals supplied thereto from said signal source and said data concerning said impulse response memorized in said memory means in a convolution integral fashion, wherein said data concerning said impulse response memorized in said memory means is read out from said memory means based on said address signal output from said address signal generating means and said digital audio signals are corrected based on said read-out data concerning said impulse response with respect to listener's head motion in a real time fashion.

* * * * *